US010744353B2

(12) United States Patent
Ballantyne

(10) Patent No.: US 10,744,353 B2
(45) Date of Patent: Aug. 18, 2020

(54) ROOF ANCHOR AND SAFETY SYSTEM AND METHOD OF USING THE SAME

(71) Applicant: Warren Ballantyne, Albion (AU)

(72) Inventor: Warren Ballantyne, Albion (AU)

( * ) Notice: Subject to any disclaimer, the term of this patent is extended or adjusted under 35 U.S.C. 154(b) by 0 days.

(21) Appl. No.: 15/584,449

(22) Filed: May 2, 2017

(65) Prior Publication Data

US 2018/0318616 A1 Nov. 8, 2018

(51) Int. Cl.
*A62B 35/00* (2006.01)

(52) U.S. Cl.
CPC ..... *A62B 35/0068* (2013.01); *A62B 35/0037* (2013.01)

(58) Field of Classification Search
CPC ..... A62B 35/0068; A62B 35/0037; A62B 35/0043; E04G 5/06; E04G 5/041; E04G 5/048; E04G 21/32; E04G 21/3204; E04G 21/3214; E04G 21/3233; E04G 21/3242; E04G 21/3223; E04G 21/3261; E04D 13/12
USPC ..... 182/5
See application file for complete search history.

(56) References Cited

U.S. PATENT DOCUMENTS 2,536,704 A * 1/1951 Shea ..... E04D 13/0722 248/48.2
3,721,147 A * 3/1973 Okugawa ..... G10C 3/106 84/186.1
4,527,660 A * 7/1985 Andruchiw ..... A62B 35/0068 118/29
5,092,426 A * 3/1992 Rhodes ..... A62B 35/0068 182/3
5,234,279 A * 8/1993 Poutanen ..... F16B 15/003 403/283
5,277,719 A * 1/1994 Kuhlman ..... C22C 21/10 148/417
5,282,597 A * 2/1994 Babcock ..... E04D 13/12 182/45
5,287,944 A * 2/1994 Woodyard ..... A62B 35/04 182/3
5,636,704 A * 6/1997 Castaneda ..... A62B 1/14 182/192
5,722,210 A * 3/1998 Baker ..... E04B 7/022 52/639
5,730,407 A * 3/1998 Ostrobrod ..... A62B 35/0043 182/231
5,896,719 A * 4/1999 Thornton ..... A62B 35/0068 182/45

(Continued)

*Primary Examiner* — Katherine W Mitchell
*Assistant Examiner* — Shiref M Mekhaeil
(74) *Attorney, Agent, or Firm* — Eandi Fitzpatrick LLP; William Fitzpatrick

(57) ABSTRACT

A roof anchor, roof anchor safety system, and method of using the same is provided herein. The roof anchor is generally for or use with a roof frame having an overhang, and has a base plate having a bottom surface configured to engage a field of the roof in a substantially planer direction, a hook portion contiguous with the base plate and having an inner surface, the inner surface of the hook portion adapted to sit proximate to or engage with the overhang of the roof, a wing contagious with the hook portion, the wing being configured to abut a portion of the overhang, wherein the base plate comprises a partially inverted portion having an aperture, the aperture adapted for coupling to a lifeline.

8 Claims, 5 Drawing Sheets

(56) References Cited

U.S. PATENT DOCUMENTS 5,901,447 A * 5/1999 Dunning ..... B26B 15/00 30/228
6,131,674 A * 10/2000 Draney ..... E21B 15/006 173/31
6,382,894 B2 * 5/2002 Goodding ..... E04D 13/158 414/11
6,695,095 B1 * 2/2004 Franke ..... E04G 21/3261 182/3
6,918,321 B1 * 7/2005 Whittaker ..... E04D 15/003 254/131.5
7,861,980 B1 * 1/2011 Verbrugge ..... E04D 13/076 248/48.1
7,980,191 B2 * 7/2011 Murphy ..... B63B 1/16 114/274
8,161,697 B1 * 4/2012 McDonald ..... E04C 2/16 428/106
8,695,307 B2 * 4/2014 Bissery ..... E04D 3/361 248/237
8,752,801 B2 * 6/2014 Parquette ..... E04G 3/26 182/45
8,968,495 B2 * 3/2015 Shepard ..... B21D 37/01 148/648
9,010,487 B2 * 4/2015 Cruz ..... E04G 21/3276 182/3
9,194,129 B2 * 11/2015 O'Donnell ..... E04G 5/041
2002/0108811 A1 * 8/2002 Ulmschneider ..... E06C 1/34 182/206
2006/0054730 A1 * 3/2006 Paterson ..... A62B 35/0093 242/382
2006/0090963 A1 * 5/2006 Liao ..... A62B 1/14 182/193
2006/0237263 A1 * 10/2006 Gaines ..... E04G 3/26 182/113
2007/0294960 A1 * 12/2007 Saurey ..... E04D 13/158 52/94
2009/0211848 A1 * 8/2009 Parker ..... A62B 1/10 182/231
2010/0006373 A1 * 1/2010 Bodnar ..... E04G 21/3214 182/36
2010/0032236 A1 * 2/2010 Morris ..... A62B 35/0056 182/112
2011/0072746 A1 * 3/2011 Dagher ..... E04B 7/20 52/302.1
2012/0031700 A1 * 2/2012 Nichols, Jr. ..... A62B 35/0068 182/3
2012/0079786 A1 * 4/2012 O'Donnell ..... E04G 5/041 52/698
2013/0206940 A1 * 8/2013 Hopkins ..... E04G 21/328 248/237

* cited by examiner

ROOF ANCHOR AND SAFETY SYSTEM AND METHOD OF USING THE SAME

CROSS-REFERENCE TO RELATED APPLICATION

Not Applicable.

FIELD OF THE INVENTION

The present invention relates generally to a roof anchor, roof anchor safety system, and method of using the same. More particularly, the invention relates to a roof anchor or roof harness device that couples to the overhang of the roof (e.g., fascia, eave, and/or soffit) without perforating the roof or shingles while minimizing damaging the underlying structure, while also preventing accidental falls to the ground by the user.

BACKGROUND OF THE INVENTION

A study by the Center for Construction Research and Training (CPWR), entitled "Fatal Falls from Roofs Among U.S. Construction Workers", found that falls from roofs accounted for one-third of fall-related construction fatalities from 1992-2009. The study also found that workers employed by small establishments, residential construction workers, Hispanic workers and immigrant workers may face disproportionately high risks of roof fatalities. A total of 20,498 occupational fatalities occurred in the construction industry from 1992-2009. Of these deaths, nearly one-third were attributed to fall injuries, with 2,163 fatalities resulting from roof falls. Citing the U.S. Bureau of Labor Statistics, the study points out that falls account for 76 percent of fatalities in the roofing industry, and workers in the roofing industry are three times more likely to experience fatal work-related injuries than other construction workers.

Many injuries and deaths occur because preventative tools and strategies are simply inefficient, ineffective, complicated, difficult and/or expensive to implement. Often, these barriers encourage unnecessary risky behavior from contractors that contribute to the injuries and fatalities mentioned above.

Known roofing safety devices, also known as "roof anchors", moor or secure the contractor or user to the roof. These devices typically have a line with one end connected to a harness or belt worn by the contractor, with the opposite end secured to some type of anchoring device. As an example, U.S. Pat. No. 5,730,407 describes roof anchors 16 and 18 positioned on opposite sides of the peak of a pitched roof 14, and that the plate members 28 and 49 of each of the roof anchors are secured in place by threading screws 32 through corresponding screw holes 30 and into the roof 14.

Other known roof anchors are comprised of a series of V-shaped components that attach the top of the roof at the ridge, and are drilled into each side of the roof directly perpendicular to the ridge of a trussed roof, and has a loop for a rope which holds the contractor. As an example, U.S. Pat. No. 5,287,944A to Woodyard teaches a roof mounted anchor having a base member formed to fit a roof and having spaced holes to receive a screw or screw like fasteners used in securing this anchor to the roof structure of a building, an integral upright anchoring eyelet structure secured to the base member in the center portion thereof and having an eyelet to receive portions of a cable, or hook, preferably a gusset integrally extending between the base member and the integral upright anchoring eyelet structure.

Yet another known safety device requires the contractor to build a structure of some type next to the home. For example, U.S. Pat. No. 6,695,095 to Franke teaches a fall protection restraint apparatus comprising a base that rests on the lowest floor surface of a building during construction. A number of poles are connected to the base sequentially, as construction height requires, to form a structurally sound column. Support cables are connected between the poles and the building under construction to horizontally support the column by forming a guyed matrix. A retractable lifeline lanyard is attached to D-rings on the end cap on the uppermost pole.

The aforementioned designs do have their drawbacks, however. For example, the known devices screw directly into the roof frame, which requires the contractor to repair the roof. This is inefficient, costly and may further damage the roof. Furthermore, in these types of designs, structural components of the roof such as the truss tend to peel away from the roof when subjected to a fall at an angle other than straight down from the roof anchor. The prior devices may not offer sufficient strength to make them capable of withstanding significant lateral and shear force. Lastly, the devices referenced above are not readily mobile.

What is needed is a roof safety apparatus that obviates the above issues.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
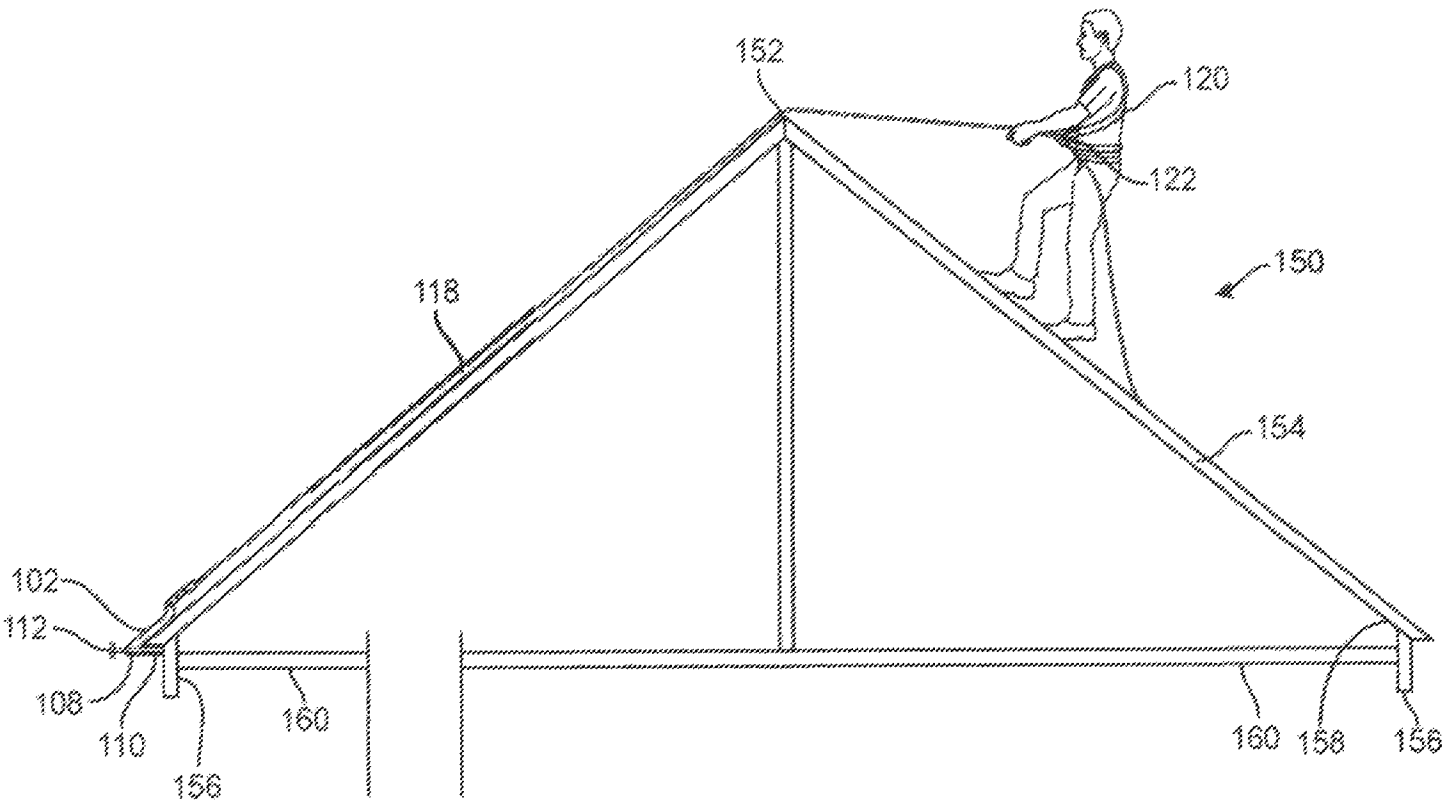
FIG. 1 is a side view of the roof anchor safety system coupled to the roof during use in accordance with embodiments of the present invention.

Unless otherwise indicated, the illustrations in the figures are not necessarily drawn to scale.

SUMMARY OF THE INVENTION

To achieve the foregoing and other aspects and in accordance with the purpose of the invention a roof anchor, and a system and method for using the roof the anchor is described herein.

It is a further object of the present invention to provide a roof anchor that is safe, reliable, and does not damage existing construction of the roof.

It is a further object of the present invention to provide a roof anchor that is capable of withstanding significant lateral and shear force.

It is a further object of the present invention to provide a roof anchor that is portable, durable in construction and easy to install without the need for any reconstruction to the underlying structure.

It is a further object of the present invention to provide a roof anchor substantially simpler in construction, dependable, easy to attach and detach, safe and comfortable in operation and relatively inexpensive to manufacture.

It is a further object of the present invention to provide a reusable anchor and anchoring system.

It is a further object of the present invention to obviate the use of scaffolding in certain situations.

In embodiments of the present invention, a roof anchor for use with a roof frame is presented. The roof anchor comprises a base plate with a bottom surface configured to engage a field of the roof in substantially planer direction, a semi-rounded hook portion contiguous with base plate and having an inner surface, the inner surface of the hook portion adapted to sit proximate to or engage with an overhang of the roof, a wing contagious with the hook portion, the wing being configured to abut a part of the overhang and/or fascia of the roof, wherein the base plate comprises a partially inverted portion having an aperture, the aperture adapted for connection to a lifeline.

In embodiments of the present invention, a safety system for attachment to a roof and configured to prevent a user from falling to the ground is presented. The safety system comprises a roof anchor comprising a base plate having a bottom surface configured to engage a field of the roof in a substantially planer direction, a semi-rounded hook portion contiguous with base plate and having an inner surface, the inner surface of the hook portion adapted to sit proximate to or engage with an overhang of the roof, a wing contagious with the hook portion, the wing being configured to at least a part of the overhang; wherein the base plate comprises a partially inverted portion having an aperture, a lifeline coupled to the aperture, a harness coupled to the lifeline at one end, the harness being adapted to fit a user.

In embodiments of the present invention, a method for preventing a user from falling to the ground is presented. The method comprises providing a roof anchor comprising a base plate with a bottom surface configured to engage a field of the roof in substantially planer direction, a semi-rounded hook portion contiguous with base plate and having an inner surface, the inner surface of the hook portion adapted to sit proximate to or engage with an overhang, a wing contagious with the hook portion, the wing being configured to abut soffit of an eave of the roof, wherein the base plate comprises a partially inverted portion having an aperture, coupling the roof anchor to a fascia, soffit, or eave of a roof, connecting a lifeline to the aperture, linking the lifeline at one end, the harness being adapted to fit a user.

Other features, advantages and aspects of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa, and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

As used herein, the term the "overhang" is meant to comprise any part or whole of the eave, soffit, and/or fascia, and generally, the edge of roof.

The roof anchor described herein may be constructed, machined or formed of suitability durable materials such as steel, aluminum, heavy plastics, fiberglass, hard wood, glass-reinforced nylon or cast of a corrosion resistant alloy such as zinc alloy or other suitable metal. Aluminum alloys ranging from relatively soft alloys, such as AL3003, to relatively hard alloys, such as AL6061, in some embodiments, are preferred. It should be noted that materials that obviate the risk of electric shock, in some circumstances, are preferred.

Referring now to FIG. 1, a side view of a roof anchor safety system is shown. The safety system comprises a roof anchor 100 that is configured to clamp or latch onto the side or overhang of the roof without damaging the underling structure, while concurrently ensuring that should a user fall off the roof, the roof anchor 100 will hold and prevent the user from falling to the ground and suffering debilitating injuries or even death. For purposes of orientation, the side view of the roof 150 is shown having a ridge 152, a field 154, fascia 156, an eave 158 and a soffit 160.

The roof anchor 100 comprises a base plate 102 having a bottom surface 104 and a top surface 106. The roof anchor 100 further comprises a semi-rounded hook portion 108 contiguous with the base plate 102, a wing 110 contiguous with the hook portion 108, and a clamping mechanism 112. The anchor further comprises a partially inverted portion 114 having an aperture 116. A lifeline 118 is coupled to the partially inverted portion 114 at one end, and to a user 120 at another via harness 122. In operation, once the roof anchor 100 is clamped to an overhang of the roof 150, the user 120 is attached to the roof 150 with a predetermined amount of lifeline 118, thereby protecting the user 120 from falling to the ground.

Figure 2:
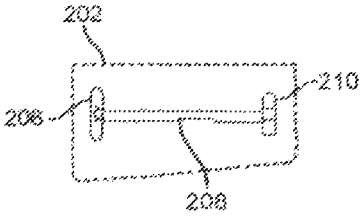
FIG. 2 is a bottom-perspective view of the roof anchor coupled to the roof in accordance with embodiments of the present invention.

Referring now to FIG. 2, a bottom perspective view of the roof anchor 100 is shown. The roof anchor 100, in some embodiments has a generally polygonal profile in which the leading edge flares outwardly and in three dimensions is generally hook-shaped. The bottom surface 104 of the base plate 102 is configured to engage a field 154 of the roof 150 in a substantially planer direction. The bottom surface 104 of the base plate 102 is formed with an opposing grain pattern to increase friction and provide a strong mating surface with the field 154 of the roof 150. The bottom surface 104 may thus be formed for high friction applications, and thus, may be manufactured from a material having a high coefficient of friction. In optional embodiments, pads and other derivatives may be attached thereto to increase the coefficient of friction to maintain the highest possible "grab" between the bottom surface 104 and the field 154 of the roof 150. In other optional embodiment, the direction of the grain of the forming material is used to increase the coefficient of friction. In other optional embodiments, potassium titanate may be added to the friction surfaces. Other additives that may be employed include polyacrylonitrile polyester, mica and blast furnace slag. Other abrasives that may be employed include quartz, silica and aluminum oxide, which will help maintain the cleanliness of mating. Other inorganics may be employed as well, such as mineral wool fibers made of magnesia or silica. Also, nitrile and diene rubbers may be used as stabilizers to promote cross-linking with the field 154 of the roof 150.

Referring still to FIG. 2, the roof anchor 100 further comprises a semi-rounded hook portion 108 which is contiguous with the base plate 102. The semi-rounded hook portion 108 is formed such that the wing 110 and base plate 102 are at an acute angle of approximately seventeen to thirty degrees, such that the clamping mechanism 202 or wing 110 is in abutting engagement with the overhang of the roof 150, which may comprise, fascia 156, eave 158 or soffit 160. In optional embodiments of the present invention, the wing 110 and base 102 form an angle of twenty-three degrees.

In embodiments of the present invention, the wing 110 is formed having rounded teeth 204 at the trailing edge of the wing 110. The rounded teeth 204 are configured to provide additional adherence to the soffit 160 in applications in which the rounded teeth 204 abut the fascia 156, while also decreasing the overall weight of the roof anchor 100. In optional embodiments, the trailing edge may be tapered and have no teeth, and in other optional embodiments, the teeth may be triangular as opposed to rounded.

The adjustable clamping mechanism 202 may comprise a screw having a flattened end (e.g., no sharp point), such as a machine screw. In this way, the user can use a drill or screw driver to tighten the screw until there is an engagement with the fascia 156 of the roof 150, or in optional embodiments the soffit 160 and/or eave 158. As used herein, the term engagement means that the clamp mechanism 202 is abutting a portion of the roof 150, but does not "screw into" or otherwise mate with or damage the portion of the roof 150 it is abutting. In operation, a friction fit type of pressure will sufficiently hold the roof anchor 100 in place without the need to drill into the soffit 160, eave 158 or fascia 156. Instead, it can be viewed as "pinching" that portion of the roof 150.

In optional embodiments, the clamping mechanism 202 may further comprise a shoe formed of metal, plastics and the like. The adjustable clamping mechanism 202 may comprise a screw with a threaded body 208 and a flattened cap 206 that in some embodiments act like a swivel pad abutting the roof 150 without doing any aesthetic or structural damage. At the opposite end of the threaded body 208 is a screw head 210. The screw head 210 may comprise, in some embodiments, a Philips or flat head engagement surface such that the user can use a drill to tighten the clamping mechanism 202. In other optional embodiments, the clamping mechanism 202 may comprise a toggle on its head such that a user can tighten the clamping mechanism 202 by hand. Furthermore, the flattened cap 206 may be formed of rubbers or other soft materials to obviate scarring on the overhang of the roof 150. The flattened cap 206 may engage that portion of the roof 150, and may be formed integrated with the threaded body 208 or be a separate attachment using the threads of the body or a friction fit.

While the clamping mechanism 202 shown is a threaded clamp, other clamps may be employed such as a web clamp, F-clamp, sliding clamp, Cardellini clamp, C-clamp (also G-clamp or G-cramp), gripes, magnetic clamp, sash clamp (a specialized, long form of bar clamp), spring clamp (first item of third row in photo), speed clamp, toggle clamp or a pinch dog.

Figure 3:
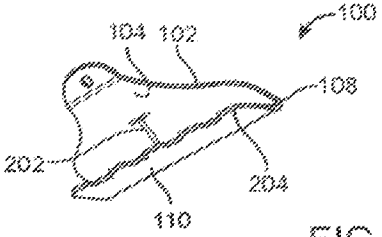
FIG. 3 is top-perspective view of the roof anchor in accordance with embodiments of the present invention.
Figure 3:
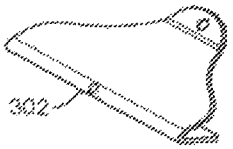

Referring now to FIG. 3, a front perspective view of the roof anchor 100 is shown. The roof anchor 100 further comprises an orifice 302. The orifice 302 is disposed of through the semi-rounded hook portion 108, and is dimensioned for the adjustable clamping mechanism 202. While it should be appreciated that the adjustable clamping mechanism 202 may take many forms, in this embodiment the adjustable clamping mechanism 202 comprises a threaded screw adapted to engage a part of the overhang, such as the soffit 160, eave 158 or fascia 156 of the roof 150 to tightly couple the roof anchor 100 to the roof 150 without damaging any portion of the roof 150.

Figure 4:
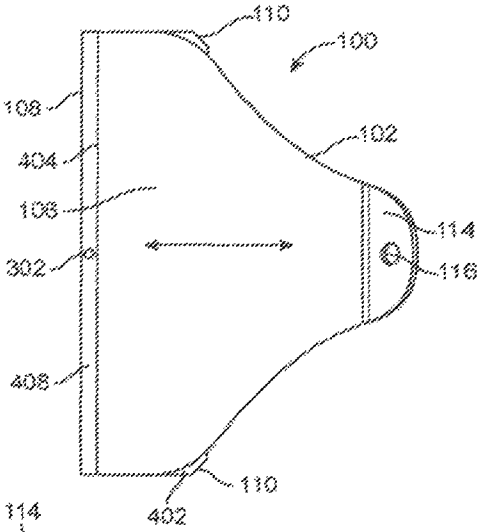
FIG. 4 is a top view of the roof anchor in accordance with embodiments of the present invention.

Referring now to FIG. 4, a top view of the roof anchor 100 is shown. In this view, the relative dimensions of the hook portion 108 can be seen. For purposes of orientations, the roof anchor showing the base plate 102, top surface 106, semi-rounded hook portion 108 and the wing 110 is shown. In this view, the inner surface 402 of the wing 110 is shown, along with the angled portion 404 of the semi-rounded hook portion 108. As shown, although the hook portion 108 is sometimes referred to as "semi-rounded", the hook 108 may be formed having a first obtuse angle, followed by steep acute angle such that the hook wraps back around the base 102 in hook-like fashion. In this way, because the semi-rounded portion hook 108 actually comprises a flattened surface 408, there is increased mating surface with the screw head 210 of the clamping mechanism 202. In operation, once the screw head 210 is threaded or screwed down, the entire screw head 210 is mated with the flattened surface 408, increasing the stability of the clamp 202.

Figure 5:
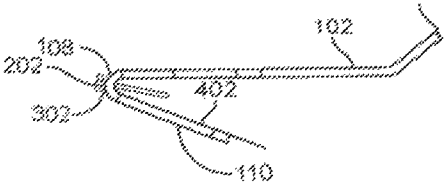
FIG. 5 is a side view of the roof anchor in accordance with embodiments of the present invention.

Referring now to FIG. 5, a side view of the roof anchor 100 is shown. For purposes of orientations, the roof anchor 100 showing the base plate 102, semi-rounded hook portion 108 and the wing 110 is shown. The clamping mechanism 202 is shown disposed through the wing 110, as is the partially inverted portion 114 and aperture 116.

In this exemplary embodiment, the partially inverted portion 114 slopes upwardly at a 40° angle. The angle between the base plate 102 and the wing 110 is set at 23°. However the range of angles may comprise the partially inverted portion 114 sloping upwardly may be between 28° and 52°, and the angle between the base 102 and the wing 110 may be 15° to 30°. In this exemplary embodiment, the dimensions of the roof anchor 100 may be as follows: The anchor top portion which includes the base 102 and the partially inverted portion 114 may be 224 millimeters in length, with the base 102 itself being 177 millimeters length. The wing 110 may be 80 millimeters in length. The width of the roof anchor 100 at its widest point may be 325 millimeters in length. Of course, all different sizes are within the purview of the invention, the size being predicated upon the application.

Figure 6:
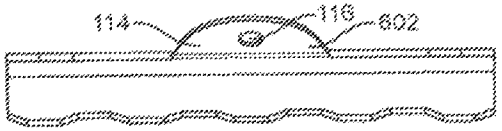
FIG. 6 is an isometric top view of the roof anchor in accordance with embodiments of the present invention.

Referring now to FIG. 6, a back-perspective view of the roof anchor 100 is shown. As shown in this view, the partially inverted portion 114 comprises a flange 602 through which the aperture 116 is disposed. The flange 602 is provided with a rounded top section to define a smooth curve, which defines the aperture 116 for receiving the coupling device (e.g., carabiner type clip). In operation, a clip or other type of strong coupling mechanism is coupled to the aperture 116 on one end and a lifeline 118 on the other, as shown generally in FIG. 7.

Figure 7:
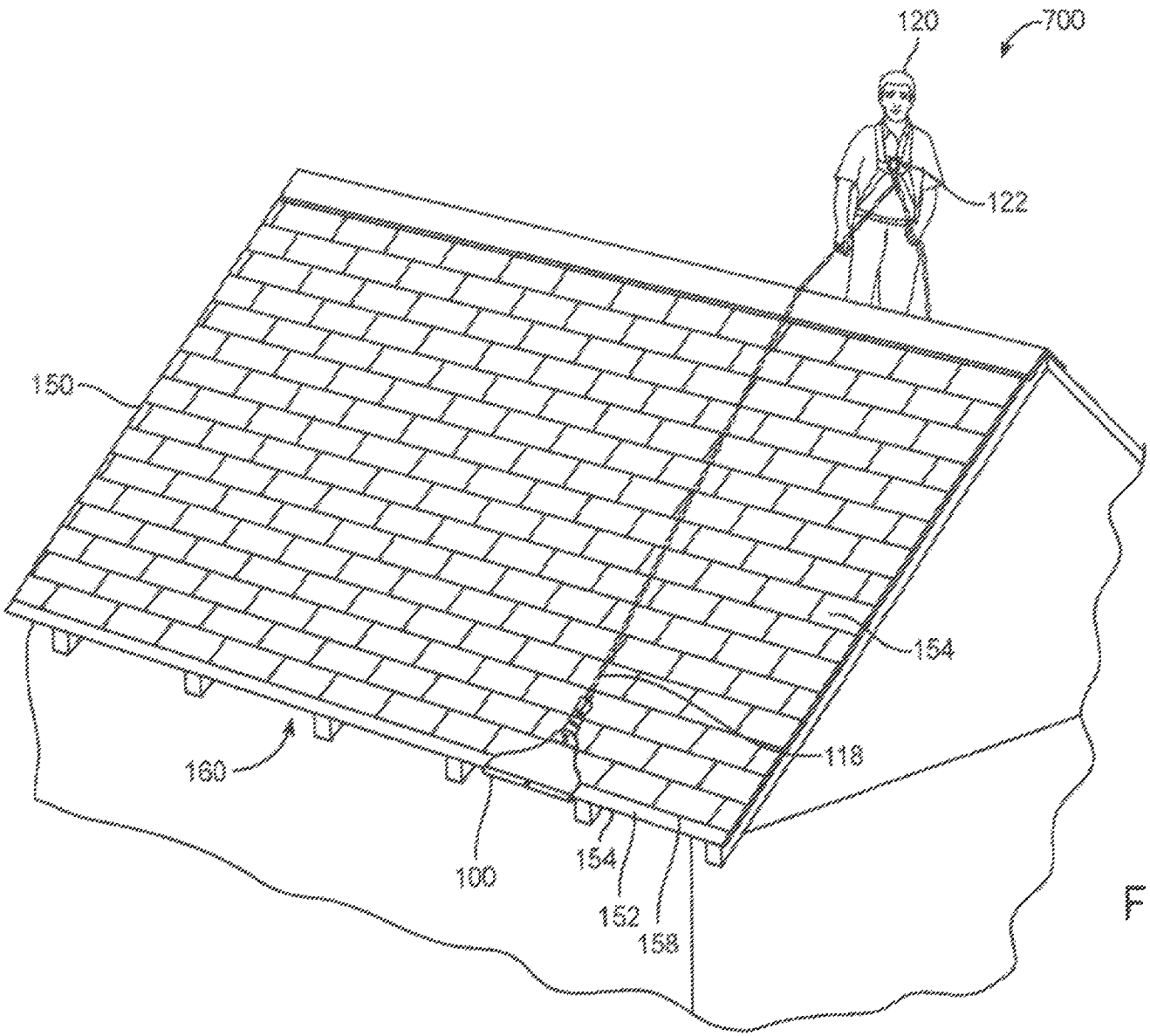
FIG. 7 is a perspective view of the roof anchor safety system coupled to the roof in accordance with embodiments of the present invention.

Referring FIG. 7, a perspective view a system for securing a user to a roof is shown generally at 700. The system comprises a roof anchor 100 as shown FIGS. 1-6. For purposes of orientation, the roof anchor 100 is shown to clamp or latch on the side of the roof 150. For purposes of orientation, the side view of the roof 150 is shown having a ridge 152, a field 154, an eave 158 and a soffit 160, the latter three generally making up the "overhang".

The roof anchor 100 comprises a base plate 102 having a bottom surface 104 and top surface 106. The roof anchor 100 further comprises a semi-rounded hook portion 108 contiguous with the base plate 102, a wing 110 contiguous with the hook portion 108, and a clamping mechanism 112. The roof anchor 100 further comprises a partially inverted portion 114 having an aperture 116. A lifeline 118 is coupled to the partially inverted portion 114 at one end, and to a user 120 at another via a harness 122.

The lifeline 118 may comprise a harness line pulley coupled to the harness 122 and configured to feed out the lifeline 118 and a locking mechanism configured to stops any feed of the lifeline 118 at a predetermined position.

The harness 122 may comprise a safety belt adapted to encircle the waist of the user 122. The safety belt is generally elliptical in shape to conform to the cross-sectional shape of the user's waist and is configured to cushions the fall arrest forces transferred by the safety belt to the waist of the user should there be a fall. The harness 122 is coupled to the lifeline 118 which is attached to the safety belt or crossed shoulder straps. As such, in operation, the body harness 122 supports the safety belt on the worker and distributes the fall arrest forces over at least the shoulders, chest, waist and thighs of the worker in the event of a fall. Any commercially available body harness that meets the fall arrest requirements as set forth by the Occupational Safety and Health Administration is suitable for use in the present invention.

Figure 8:
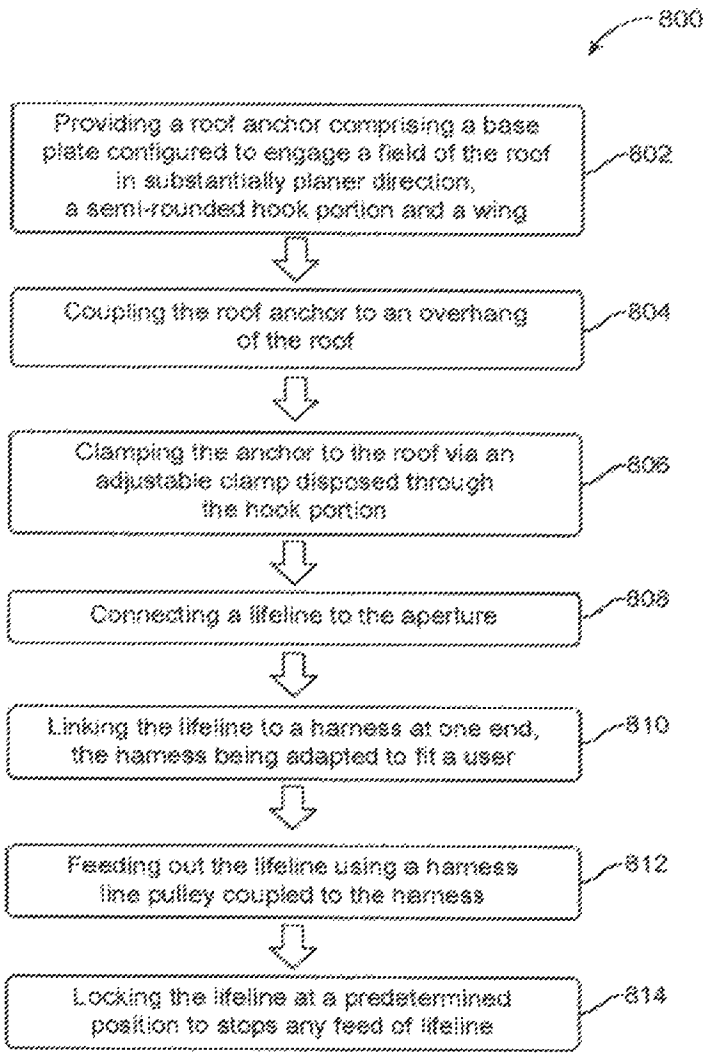
FIG. 8 is a step-wise diagram in accordance with embodiments of the present invention.

Referring now to FIG. 8, a stepwise flowchart showing a method for preventing a user from falling to the ground is shown generally at 800.

At step 802, a roof anchor is provided. The roof anchor is like the one shown in FIGS. 1-7. The roof anchor comprises a base plate comprising a bottom surface configured to engage a field of the roof in substantially planer direction, a semi-rounded hook portion contiguous with base plate and having an inner surface, the inner surface of the hook portion adapted to sit proximate to or engage with a fascia of the roof, a wing contagious with the hook portion, the wing being configured to abut soffit of an eave of the roof. The base plate comprises a partially inverted portion having an aperture.

At step 804, the user couples the roof anchor to an overhang of the roof. The overhang may comprise, in any parts or portions, the eave, fascia, and/or soffit.

At step 806, the user clamps the anchor to the roof clamping the anchor to the roof via an adjustable clamp disposed through the wing, the adjustable clamp comprising a flattened swivel shoe configured to engage the soffit to tightly couple the base to the field of the roof.

At step 808, the user connects a lifeline to the aperture of the anchor.

At step 810, the user links the lifeline to a safety harness at one end, the harness being adapted to fit the user on the other end.

At step 812, the user feeds out the lifeline us a lifeline pulley coupled to the harness At step 814, the user locks the lifeline at a predetermined position to stops any feed of lifeline.

Figure 9:
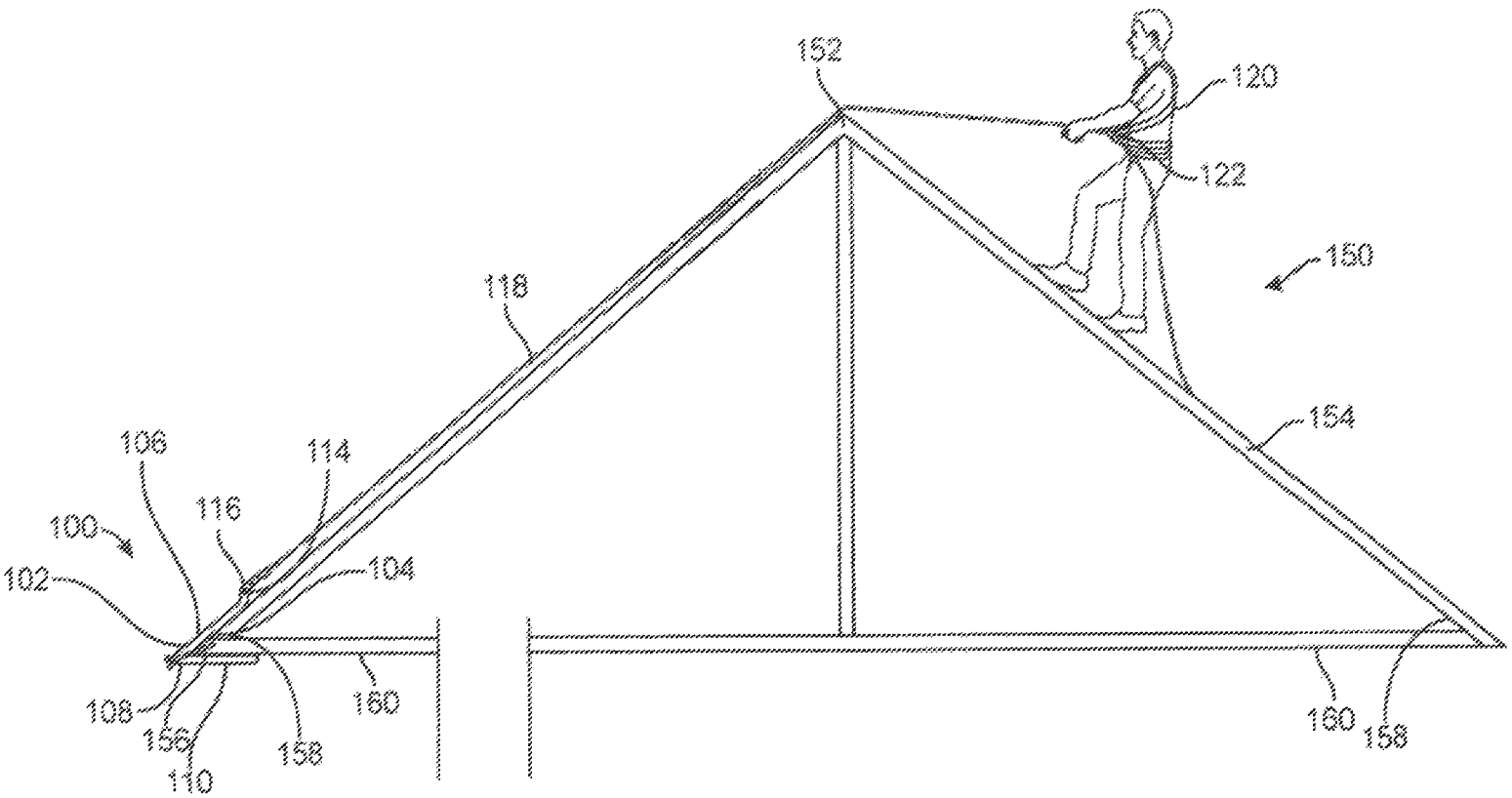
FIG. 9 is a side view of the roof anchor safety system coupled to the roof during use in accordance with embodiments of the present invention.

Referring now to FIG. 9, a side view of a roof anchor safety system is shown. Like the embodiment shown in FIG. 1, the safety system comprises a roof anchor 100 that is configured to clamp or latch onto the side or overhang of the roof without damaging the underling structure, while concurrently ensuring that should a user fall off the roof, the roof anchor 100 will hold and prevent the user from falling to the ground and suffering debilitating injuries or even death. For purposes of orientation, the side view of the roof 150 is shown having a ridge 152, a field 154, fascia 156, an eave 158 and a soffit 160.

However, in this embodiment, the wing 110 and clamp 152 such that the clamping mechanism 202 and/or wing 110 is in abutting engagement with the soffit 160. In optional embodiments, the clamping mechanism may screw into the soffit 160, forming only a small hole to be patched.

Like in FIG. 1, the roof anchor 100 comprises a base plate 102 having a bottom surface 104 and a top surface 106. The roof anchor 100 further comprises a semi-rounded hook portion 108 contiguous with the base plate 102, a wing 110 contiguous with the hook portion 108, and a clamping mechanism 112. The anchor further comprises a partially inverted portion 114 having an aperture 116. A lifeline 118 is coupled to the partially inverted portion 114 at one end, and to a user 120 at another via harness 122. In operation, once the roof anchor 100 is clamped to an overhang of the roof 150, the user 120 is attached to the roof 150 with a predetermined amount of lifeline 118, thereby protecting the user 120 from falling to the ground.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

Although specific features of various embodiments of the invention may be shown in some drawings and not in others, this is for convenience only. In accordance with the principles of the invention, the feature(s) of one drawing may be combined with any or all of the features in any of the other drawings. The words "including," "comprising," "having," and "with" as used herein are to be interpreted broadly and comprehensively and are not limited to any physical interconnection. Moreover, any embodiments disclosed herein are not to be interpreted as the only possible embodiments. Rather, modifications and other embodiments are intended to be included within the scope of the appended claims.

I claim:

1. A roof anchor for use with a roof frame having an overhang, the roof anchor comprising:

a base plate comprising a bottom surface configured to engage a field of the roof in a substantially planer direction, wherein the base plate is flush to the field of the roof on a lower portion of the base plate;

a hook portion contiguous with the base plate and having an inner surface, the inner surface of the hook portion sitting proximate to or engaged with the overhang of the roof, a wing contiguous with the hook portion, the wing abuts a portion of the overhang; said overhang includes an eave, a fascia and a soffit;

a single adjustable screw disposed through an orifice of the hook portion, wherein the adjustable screw comprises:

a threaded body that, when rotated, moves toward the eave and the soffit of the roof; and a single end of the adjustable screw that, when rotated, engages the eave and the fascia or the soffit of the roof to tightly couple the roof anchor to the roof, wherein the base plate comprises a partially inverted portion having an aperture, the aperture for coupling to a lifeline.

2. The roof anchor of claim 1, wherein the hook portion is formed such that the wing and base are at an acute angle of approximately seventeen to thirty degrees, the wing is in abutting engagement with the eave of the overhang.

3. The roof anchor of claim 1, wherein the wing comprises rounded teeth at an end, the teeth configured to provide additional adherence to the soffit.

4. A safety system for attachment to a roof, the system configured to prevent a user from falling to the ground, the safety system comprising:

a roof anchor comprising:

a base plate having a bottom surface configured to engage a field of the roof in a substantially planer direction, wherein the base plate is flush to the field of the roof on a lower portion of the base plate;

a hook portion contiguous with the base plate and having an inner surface, the inner surface of the hook portion sits proximate to or engages with an overhang of the roof; said overhang includes an eave, a fascia and a soffit;

an adjustable screw disposed through an orifice of the hook portion, wherein the adjustable screw comprises:

a single adjustable screw disposed through an orifice of the hook portion, wherein the adjustable screw comprises:

a threaded body that, when rotated, moves toward the eave and the soffit of the roof; and a single end of the adjustable screw that, when rotated, engages the eave and the fascia or the soffit of the roof to tightly couple the roof anchor to the roof;

a wing contiguous with the hook portion, the wing abuts the overhang of the roof;

wherein the base plate comprises a partially inverted portion having an aperture;

a lifeline coupled to the aperture;

a harness coupled to the lifeline at one end, the harness being adapted to fit a user.

5. The safety system of claim 4, further comprising:

a harness line pulley coupled to the harness and configured to feed out the lifeline;

a locking mechanism configured to stop any feed of the lifeline at a predetermined position.

6. The system of claim 4, wherein the hook portion of the roof anchor is formed such that the wing and base are at an acute angle of approximately seventeen to thirty degrees, such that the wing is in abutting engagement with the eave of the overhang.

7. The system of claim 4, wherein the wing of the roof anchor comprises rounded teeth at its end, the teeth configured to provide additional adherence to the soffit.

8. A method for preventing a user from falling to the ground, the method comprising: providing the roof anchor of claim 1; wherein:

the base plate comprising the bottom surface configured to engage the field of the roof in substantially planer direction, wherein the base plate is flush to the field of the roof on the lower portion of the base plate;

the hook portion contiguous with base plate and having the inner surface, the inner surface of the hook portion sits proximate to or engages with the overhang of the roof, the wing contiguous with the hook portion, the wing abutting the overhang of the roof, the single adjustable screw disposed through the orifice of the hook portion, wherein the adjustable screw comprises:

the threaded body configured to that, when rotated, move moves toward the eave and the soffit of the roof; and the single end adapted to of the adjustable screw that, when rotated, engages the eave and the fascia or the soffit of the roof to tightly couple the roof anchor to the roof, wherein the base plate comprises the partially inverted portion having the aperture;

coupling the roof anchor to the overhang of the roof, connecting the lifeline to the aperture;

linking the lifeline at one end to the harness, the harness being adapted to fit the user.

* * * * *